US006508001B2

(12) United States Patent
Adrian

(10) Patent No.: US 6,508,001 B2
(45) Date of Patent: Jan. 21, 2003

(54) METHOD AND APPARATUS FOR FORMING A WIRE

(75) Inventor: Manea Adrian, Timisoara (RO)

(73) Assignee: Adipaz Ltd., Jerusalem-Talpiot (IL)

( * ) Notice: Subject to any disclaimer, the term of this patent is extended or adjusted under 35 U.S.C. 154(b) by 0 days.

(21) Appl. No.: 10/015,213

(22) Filed: Nov. 16, 2001

(65) Prior Publication Data

US 2002/0040572 A1 Apr. 11, 2002

Related U.S. Application Data

(62) Division of application No. 09/422,755, filed on Oct. 21, 1999, now Pat. No. 6,370,860.

(51) Int. Cl.[7] ..... B21L 11/00; B21L 17/00; B21C 23/08

(52) U.S. Cl. ..... 29/896.43; 59/35.1; 72/264; 72/269; 72/274

(58) Field of Search ..... 72/264, 265, 269, 72/274, 276, 278, 283; 29/896.41, 896.43; 59/35.1, 80

(56) References Cited

U.S. PATENT DOCUMENTS

| | | | | |
|---|---|---|---|---|
| 407,723 A | | 7/1889 | Crook | |
| 1,384,448 A | * | 7/1921 | Gilbert et al. | 72/278 |
| 1,847,365 A | * | 3/1932 | Skinner | 72/269 |
| 1,929,695 A | * | 10/1933 | Julien | 72/274 |
| 2,164,397 A | * | 7/1939 | Ganoe | 72/269 |
| 4,300,378 A | * | 11/1981 | Thiruvarudchelvan | 72/264 |
| 5,185,995 A | | 2/1993 | Dal Monte | |
| 5,285,625 A | | 2/1994 | Ofrat et al. | |
| 5,303,540 A | | 4/1994 | Rozenwasser | |
| 5,412,935 A | | 5/1995 | Rozenwasser | |
| 5,452,572 A | | 9/1995 | Alvaro et al. | |
| 5,531,065 A | | 7/1996 | Rozenwasser | |
| 5,537,812 A | | 7/1996 | Rozenwasser | |
| 5,660,036 A | | 8/1997 | Rozenwasser | |

* cited by examiner

*Primary Examiner*—David Jones
(74) *Attorney, Agent, or Firm*—Katten Muchin Zavis Rosenman

(57) ABSTRACT

A solid wire of precious metal, such as gold, is drawn through a die which has a groove forming element disposed in a drawing channel located between the inlet and outlet of the die. The hollow wire exiting the die has an eccentric longitudinal open groove extending axially along the wire and embraced by a pair of tapered arms or cusps. The solid portion of the hollow wire is provided with a thick wall portion that is particularly adapted for forming diamond cut facets.

16 Claims, 4 Drawing Sheets

METHOD AND APPARATUS FOR FORMING A WIRE

CROSS-REFERENCES TO RELATED APPLICATIONS

This is a division of U.S. application Ser. No. 09/422,755 filed Oct. 21, 1999, now U.S. Pat. No. 6,370,860

BACKGROUND OF THE INVENTION

1. Field of the Invention

The present invention relates in general to hollow wire used in the construction of jewelry, and relates in particular to a method and apparatus for forming hollow wire links for constructing jewelry rope chains.

2. Description of Prior Developments

Jewelry rope chain is produced by forming precious metal wire into individual links and then interconnecting the links in a known fashion to form a helical chain. Examples of such chains and their construction are provided in U.S. Pat. Nos. 5,537,812, 5,660,036 and 5,303,540.

In some cases, it is desirable for form a series of flat reflective surfaces along the chain links to enhance the light reflecting characteristics of the chain. Diamond cutting tools and diamond grinding wheels are used to form such flat faceted surfaces and produce what is known as "diamond cut" jewelry chains. An example of such diamond cut jewelry rope chain is disclosed in U.S. Pat. No. 5,285,625.

A problem arises when hollow wire is used to form diamond cut jewelry chains. Although hollow wire is desirable because it reduces the amount of precious metal required to form a rope chain, the resulting thin walls of the hollow chain links can be perforated during the diamond cutting of the facets in the thin walls. This penetration of the faceted surface through the thin hollow links forms a hole that ruins the rope chains.

Accordingly, a need exists for a hollow wire for forming hollow rope chain links and other articles of jewelry, including machine and hand made chains, and which allows full faceting without the risk of penetrating the link during diamond cutting of a facet.

A further need exists for a method and apparatus for forming hollow rope chain having a thickened wall portion particularly adapted for faceting by a diamond cutting operation.

SUMMARY OF THE INVENTION

The present invention has been developed to fulfill the needs noted above and therefore has as an object the provision of a method and apparatus for forming a hollow wire particularly adapted for producing diamond cut faceted surfaces such as used in jewelry rope chain links.

Another object of the invention is the provision of a hollow wire having internal and external mechanically worked surfaces formed by drawing a solid wire through a die.

Another object of the invention is the provision of a die having a groove forming element adapted to form an open internal groove in a solid wire so as to produce a thick walled section in a hollow wire.

Still another object of the invention is the provision of a hollow chain link particularly adapted for forming faceted diamond cut rope chains.

These and other objects are met by the present invention which is directed to a method and apparatus for forming hollow wire and hollow chain links adapted for producing diamond cut faceted jewelry rope chains. A wire drawing die is formed with a conical bore defining a wire drawing channel. A groove forming element such as a hard wire rod is mounted in the channel.

As a solid wire of soft precious metal, such as gold or silver, is drawn through the die, the groove forming element forms an axially-extending longitudinal groove along one side of the drawn hollow wire. The remaining solid section of the drawn wire is formed with a central thick-walled portion particularly adapted for faceting. A pair of thin-walled sections extend circumferentially from the central thick-walled portion so as to embrace and surround the drawn groove. Diamond cut facets can be formed in the central thick-walled portion of the chain links formed by the hollow wire. Such facets can be identical to those formed in conventional solid wire but by using a hollow wire, the hollow links can weigh up to 50% less than solid wire links.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawings, like reference characters designate like parts.

DETAILED DESCRIPTION OF THE PREFERRED EMBODIMENTS

Figure 1A:
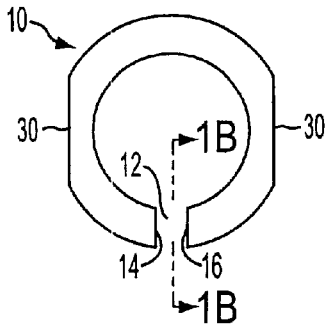
FIG. 1A (PRIOR ART)
FIG. 1A is a front view of a faceted jewelry rope chain link constructed in accordance with the prior art.

In order to better appreciate the benefits and the advantages of the present invention, a brief review of the prior art will be helpful. As seen in FIG. 1A, a conventional hollow chain link 10 is shown having a generally annular shape defined by a curled or coiled strip of hollow wire. The wire is typically formed of a precious metal such as a gold or silver alloy.

Figure 1B:
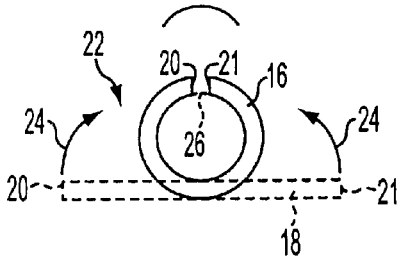
FIG. 1B (PRIOR ART)
FIG. 1B is a view of the end face of the link of FIG. 1A, taken along radial section line 1B—1B thereof and showing in dashed lines a strip of material used to form the link.

The radial cross section through link 10 is typically circular as shown in FIG. 1B, so as to define a tubular cylindrical ring of substantially uniform wall thickness. As further seen if FIGS. 1A and 1B, link 10 is formed with a circumferential gap 12 which is bordered by a pair of opposed axial end faces 14, 16.

As seen in dashed lines in FIG. 1B, link 10 is typically formed from a flat rectangular strip 18 of precious metal. The longitudinal sides of the strip are curled over towards one another, as shown by the directional arrows 24, so as to form a hollow tube 22. Tube 22 typically includes a thin longitudinal gap 26 defined between edges 20, 21 of the curled over flat strip.

Figure 3:
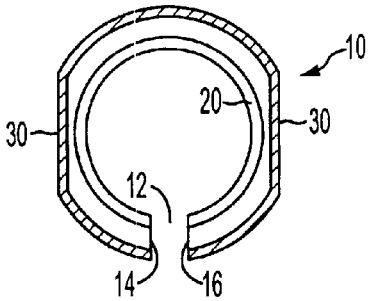
FIG. 3 (PRIOR ART)
FIG. 3 is a view in central radial section taken through section line 3—3 of FIG. 2.

Tube 22 in turn is curled into a circular or other shaped open loop such as shown in FIGS. 1A and 3 so as to produce a rope chain link 10. A jewelry rope chain is constructed in a known manner by inserting one link 10 into another link 10 through each respective gap 12 thereby interconnecting a series of links 10 into a flexible chain. The alternate pairs of links are subsequently brazed or soldered to complete the chain fabrication.

Figure 2:
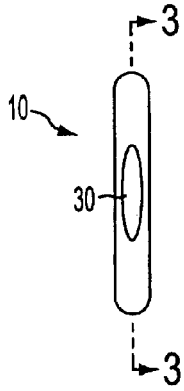
FIG. 2 (PRIOR ART)
FIG. 2 is a side view of the link of FIGS. 1A and 1B.
Figure 4:
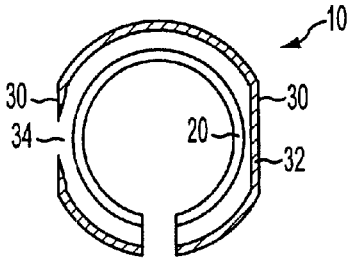
FIG. 4 (PRIOR ART)
FIG. 4 is a view similar to FIG. 3, showing the formation of a hole through the wall of the link caused by a faulty diamond cutting operation.

If desired, flat faceted surfaces can be subsequently cut or ground on the outer surfaces of some or all of the links 10 as they are arranged in a rope chain to enhance the light reflecting characteristics of the links and thereby provide a sparkling appearance to the links. As seen in FIGS. 1A, 2 and 3, flat facets 30 are cut at selected locations on the link 10. A problem arises when a facet 30 is cut too deep into the wall of a link 10. As seen in FIG. 4, a very thin weak wall section 32 can result. Such a section is prone to denting, perforation or other damage. Even worse, if the diamond cutting operation breaks through the wall of the tube 22 which forms link 10, a hole 34 results. Such a hole requires replacement of a portion of chain including the perforated link and can involve a costly and time consuming operation.

Figure 5:
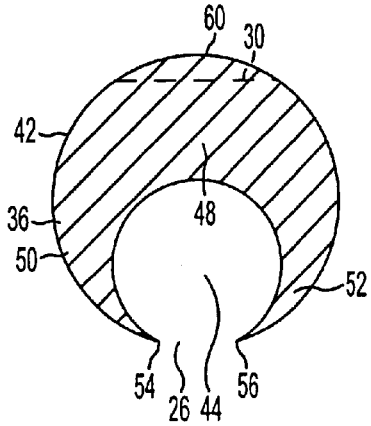
FIG. 5 is a view in radial section through a hollow wire constructed in accordance with a first embodiment of the invention.
Figure 11:
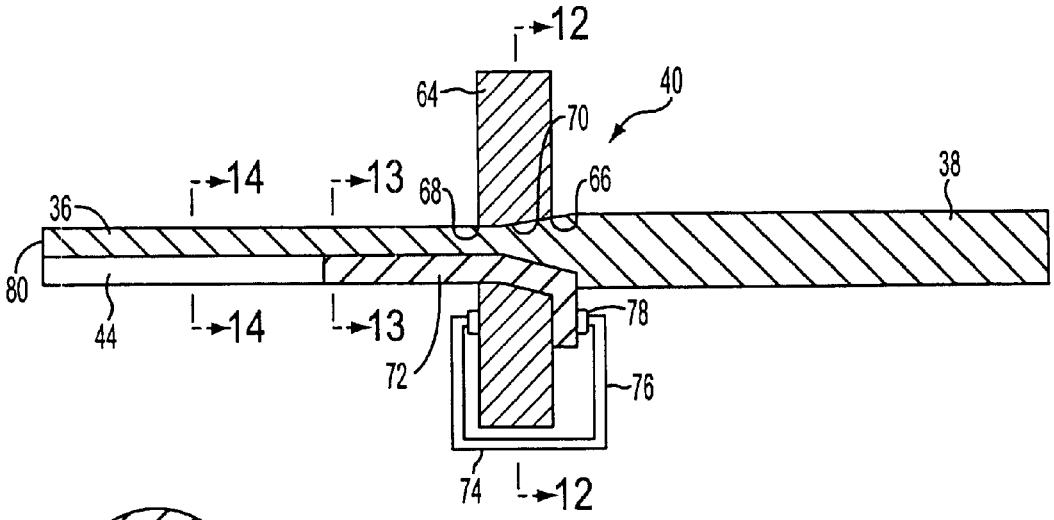
FIG. 11 is a schematic view, in section, showing a drawing die and a wire being drawn through the die in accordance with the invention.
Figure 15:
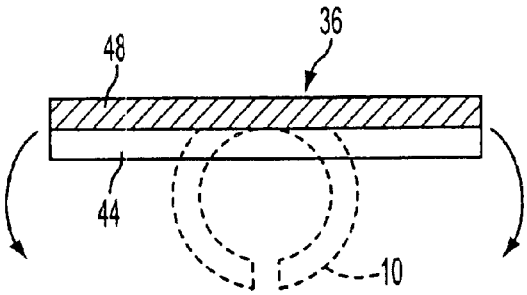
FIG. 15 is a view in central section of a strip of hollow wire taken from the die of FIG. 11 and showing in dashed lines the formation of a jewelry chain link.

In order to reduce or eliminate the possibility of forming a weak wall section 32 or hole 34, a hollow wire 36, as seen, for example, in FIGS. 5, 11 and 15, has been developed in accordance with the present invention. Rather than curling a strip of flat sheet metal into a tube and then curling or bending the tube into an open loop as described above, a length of solid wire 38 (FIG. 11) is drawn through a die assembly 40 to form a hollow wire 36 having an asymmetrical cross section particularly suited for forming diamond cut facets 30.

As seen in FIG. 5, wire 36 has a substantially circular outer circumference or periphery 42 which is interrupted by a small mouth or gap 26 which is formed during the wire drawing process discussed further below. An axially-extending longitudinal groove or channel 44 is formed along one side of the wire 36. Groove 44 extends internally and eccentrically within the wire 36 and communicates with gap 26 at the outer circumference of the wire 36.

Figure 6:
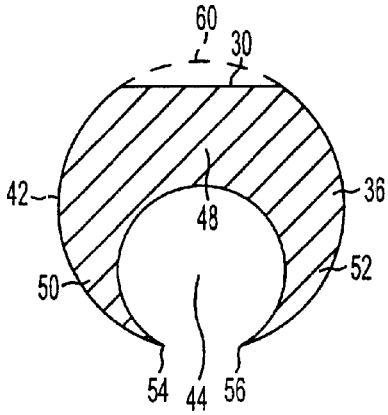
FIG. 6 is a view of the wire of FIG. 5 after a diamond cutting operation.

The resulting radial cross section of wire 36, as seen in FIG. 5, includes a thick wall portion 48 and a pair of thin wall arm portions 50, 52 which respectively lead to a pair of pointed cusps 54, 56. The thick wall portion 48 has an outer surface portion 60 which is particularly adapted for forming diamond cut facets 30, as seen in dashed lines in FIG. 5 and in solid line in FIG. 6. FIG. 6 shows a section through wire 36 after a facet 30 has been cut on its outer surface portion 60 which extends circumferentially over the thickest portion of thick wall portion 48. The dashed lines in FIG. 6 show where metal has been cut away from outer surfaces 42 and 60.

As further seen in FIG. 6, even though outer surface portion 60 has been removed, there is still a significant amount of precious metal (such as gold or silver) remaining between facet 30 and internal groove 44. This thick section of material remaining in thick wall portion 48 reduces or eliminates the possibility of a diamond cutting tool or diamond cutting paper from breaking into groove 44 or from forming a thin weak wall section as discussed above in connection with FIG. 4.

Although hollow wire 36 is shown formed with diamond cut facets 30, it is more common to form facets 30 on a chain link formed of wire 36 after the link has been assembled into a jewelry rope chain. In order to get the most benefit of the safety provided by thick wall section 48, it is desirable to form facets 30 diametrically and symmetrically opposite to channel or groove 44 and gap 26. In this manner, facets 30 are cut into the thickest section of thick wall portion 48.

Although groove 44 is shown in FIGS. 5 and 6 as having a substantially circular cross section so as to define a crescent-shaped or C-shaped radial cross section across wire 36, other cross sections can be formed across channel or groove 44 in accordance with the invention. For example, oval, square, hexagonal, octagonal, polygonal, and irregular cross sections can be formed by a simple die insert change procedure as discussed further below.

Figure 7:
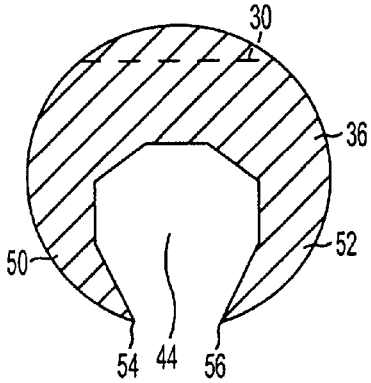
FIGS. 7, 8, 9 and 10 are views similar to FIG. 5 showing other embodiments of the invention.
Figure 8:
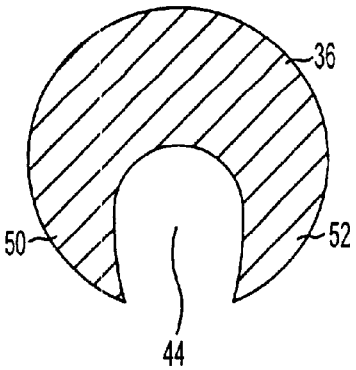
Figure 9:
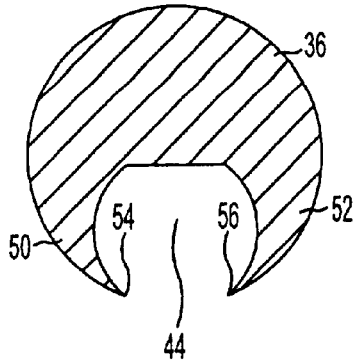
Figure 10:
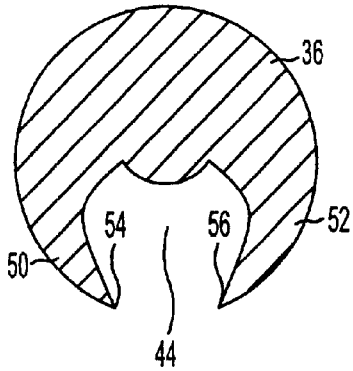

FIG. 7 shows a wire 36 having a generally polygonal cross section formed across groove 44. FIG. 8 shows a wire 36 having a generally oval cross section formed across groove 44. FIG. 9 shows a wire 36 having a flattened or truncated circular cross section formed across groove 44, and FIG. 10 shows a wire 36 having an irregular cross section formed across groove 44.

As seen in FIG. 11, a die assembly 40 is provided for forming a hollow wire 36 in accordance with the invention. Die assembly 40 includes a die plate 64 formed with an inlet 66, an outlet 68 and a drawing channel 70 formed between the inlet and outlet. Inlet 66 can be formed as a circular port as can outlet 68, with inlet 66 having a diameter greater than outlet 68. Drawing channel 70 can then be formed as a conical bore. However, other specialized cross sections can be provided on the inlet 66, outlet 68 and channel 70.

A groove forming element such as a thin metal rod 72 is provided in the drawing channel 70. Rod 72 is removably mounted between the inlet 66 and outlet 68 with, for example, a clamp 74. Clamp 74 includes a pair of resilient clamp arms 76 and a pair of clamp pads 78 for clamping rod 72 in a selected position on the die plate 64. Such rod 72 may also be fastened with a bolt or the like, screwed into the die plate 64.

Figure 13:
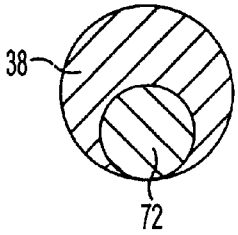
FIG. 13 is a view in section taken through line 13—13 of FIG. 11.
Figure 14:
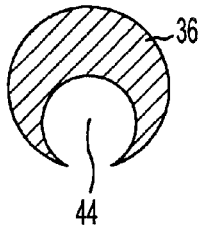
FIG. 14 is a view in section taken through line 14—14 of FIG. 11.
Figure 12:
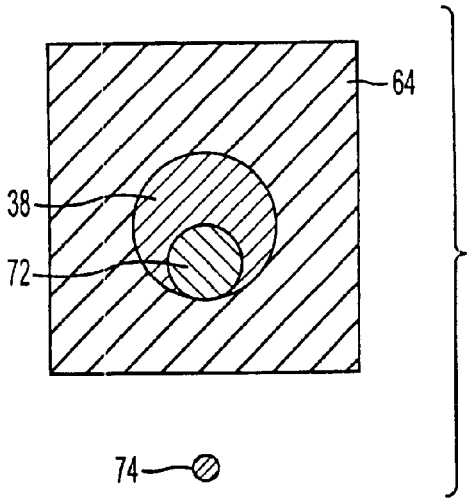
FIG. 12 is a view in section taken through line 12—12 of FIG. 11.

Rod 72 can be formed of a thin steel wire having any desired cross section. As seen in FIGS. 12 and 13, rod 72 is formed of a wire having a circular cross section so as to form groove 44 with a circular cross section within wire 38.

Wire 36 is formed by inserting the front end 80 of wire 38 into the inlet 66 of drawing channel 70. The front end 80 of wire 38 may be initially tapered to allow it to pass through channel 70 and be grabbed from the outlet side of die plate 64. Wire 38 is then pulled through channel 70 and die outlet 68 so as to form a drawn hollow wire 36.

As an example, solid wire 38 can have an initial starting diameter of about 1.8 mm and rod 72 can be formed of a steel wire having a circular cross section with a diameter of 0.63 mm. After successive passes through a series of drawing channels 70, a hollow wire 36 is formed which is about 40% lighter in weight than an equivalent solid wire. In addition, a full standard diamond cut facet formed on a finished rope chain constructed of chain links formed with this hollow wire 36 presents an external appearance identical to an equivalent diamond cut faceted chain formed of solid chain links.

It can be appreciated that a jewelry rope chain constructed of chain links formed of hollow wire 36 provides a significant weight savings in precious metal, yet provides sufficient material beneath the outer periphery of each link to enable a full diamond cut faceting operation to be carried out without compromising the physical integrity and strength of the chain links. This advantage is achieved by offsetting groove 44 from the center of the wire and link cross section in a direction toward the inner periphery of the link.

In a preferred embodiment of the invention, precious metal solid wire 38 having a diameter of about twice that of the final diameter of hollow wire 36 is drawn through a series of circular (or other shaped) drawing die assemblies 40 having successively smaller outlets 68. Rod 72 is preferably formed of a short length of tungsten carbide, high carbon steel or other hard wire. The final cross section and diameter of rod 72 determines the groove cross section and diameter of hollow wire 36.

The advantages of forming hollow wire 36 with a radially offset or eccentric groove 44 become evident during the manufacture of chain links from the hollow wire 36.

Figure 19:
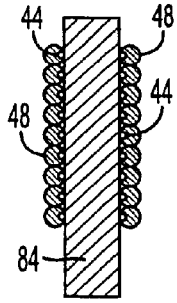
FIG. 19 is a view in section through section line 19—19 of FIG. 18.

As hollow wire 36 is guided onto a rotating spindle 84 in a known fashion as shown in FIG. 19, such as when wire 36 exits a die assembly similar to die assembly 40 of FIG. 11, mouth 26 of groove 44 is presented and guided onto the spindle such that groove 44 intersects or abuts the spindle along the tips of the cusps 54, 56 and extends around the inner periphery or inner circumference of each coil of wire as seen in FIG. 19. The formed coiled wire 36 is then cut into individual annular links that are then assembled and soldered in a known manner into a jewelry rope chain. Such as chain is virtually identical in appearance to solid and standard jewelry rope chains.

Figure 18:
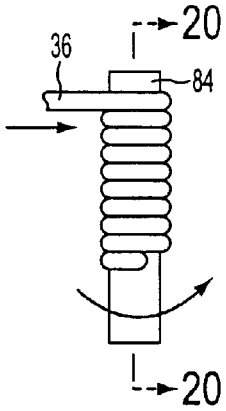
FIG. 18 is a schematic view of a coil of wire taken from the die of FIG. 11 and formed around a spindle.

Of course, individual lengths of wire 36 can be bent and coiled into a link 10 as shown in FIG. 15. In any event, whether link 10 is formed as in FIG. 15, as in FIGS. 18 and 19 or in any other manner, the mouth 26 of groove 44 faces and extends around the inner periphery of the link and the thick wall portion 48 extends around the outer circumference or periphery of each link. This is best seen in FIG. 16 where the outer portion 60 of the link is shown in dashed lines as being cut away to form facets 30 and the cusps 54 and 56 extend around and define the inner circumference of the link.

Figure 16:
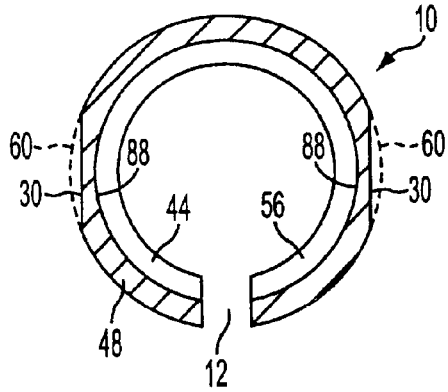
FIG. 16 is a sectional view of a jewelry chain link constructed as shown in FIG. 15, after diamond cutting.

As further seen in FIG. 16, the link 10 formed of wire 36 can have several facets 30 formed on its outer circumference. In each case, the remaining wall portion 88 of the thick wall portion 48 of wire 36 which is located beneath or radially inwardly of each facet 30 is sufficiently thick in the radial direction to prevent excessive weakening or perforation of wall 48.

Figure 17:
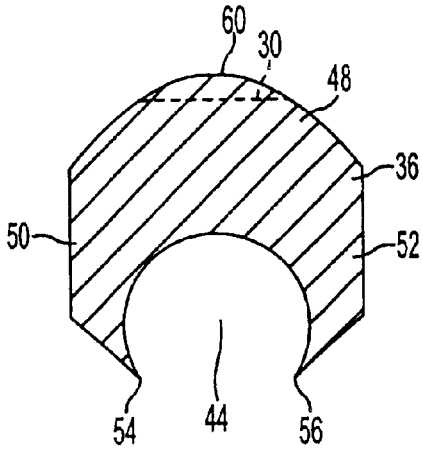
FIG. 17 is a view similar to FIG. 5 depicting another embodiment of the invention.

A further variation of the invention is shown in FIG. 17 wherein the outer periphery of wire 36 is formed with a generally octagonal shape, with a curved or arched portion 60 located diametrically opposite groove 44. Virtually any shape can be provided on the outer periphery of wire 36 by appropriate shaping of the cross section of drawing channel 70 and outlet 68, or by cutting a profile around the outer periphery of wire 36 using known wire cutting and shaping techniques.

Figure 20:
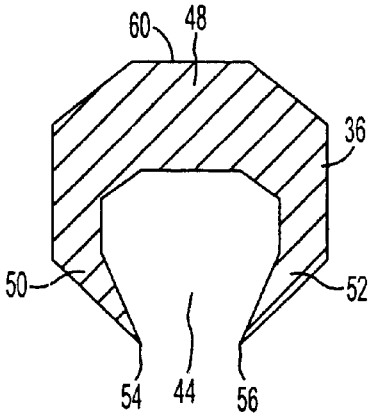
FIGS. 20, 21 and 22 are views in radial section similar to FIGS. 5 through 10 showing additional embodiments of a hollow wire constructed in accordance with the invention.
Figure 21:
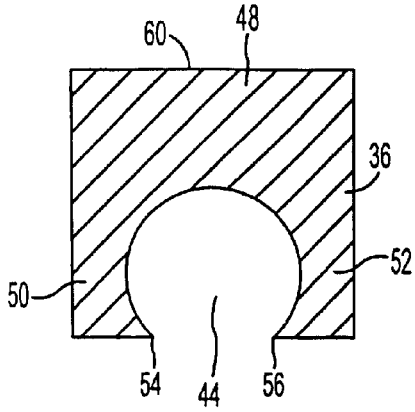
Figure 22:
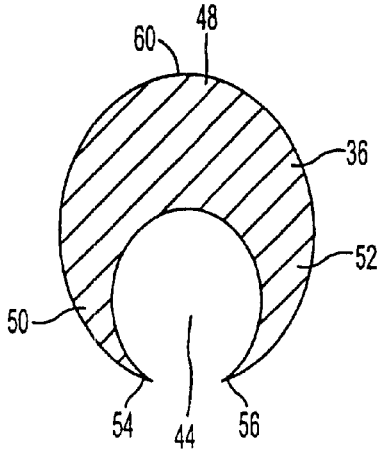

For example, FIG. 20 depicts a wire 36 having a polygonal outer periphery or circumference and a polygonal inner periphery defining the cross section of groove 44. FIG. 21 shows a wire 36 having a generally square outer periphery and a groove 44 having a generally circular cross section. FIG. 22 depicts a wire 36 having an elongated or oval outer periphery and a groove 44 having an elongated or oval cross section.

In each example of wire 36 formed in accordance with the invention, wire 36 includes a thick wall portion and a pair of arms 50, 52 which taper into cusps 54, 56 which arms and cusps together encircle and embrace the internal groove 44. That is, arms 50, 52 define an open mouth gap 26 in the outer periphery of wire 36 and taper toward one another so as to terminate at pointed cusps 54, 56. The arms 50, 52 are typically thinner in radial section than the thick walled portion, and the center of groove 44 is preferably radially offset from the center of wire 36 in a direction toward mouth 26, i.e., radially away from and spaced diametrically opposite to the thick wall portion 48.

In this manner, groove 44 is located eccentrically within wire 36 so as to provide a thick wall portion 48 opposite to groove 44 for facilitating subsequent diamond cutting operations on the thick wall portion. When the groove 44 and outer periphery of the wire 36 are drawn through a die assembly such as die assembly 40, the outer surface of the wire is mechanically worked, as in the inner surface of groove 44 which passes over the groove forming element 72.

It should be noted that while drawing wire 36 through a series of progressive dies is a desired method of manufacture, other methods are also possible such as cutting groove 44 with a shaped and contoured saw or cutting wheel having a cutting section corresponding to the desired cross section of groove 44, or by rolling wire through suitably profiled rollers.

There has been disclosed heretofore the best embodiment of the invention presently contemplated. However, it is to be understood that the various changes and modifications may be made thereto without departing from the spirit of the invention.

What is claimed is:

1. A method of producing a hollow jewelry item comprising the steps of:

providing a drawing die having an inlet and an outlet;

providing a groove forming member between said inlet and said outlet;

inserting a wire into said inlet;

drawing said wire over said groove forming member and through said outlet;

forming a groove along said wire with said groove forming member as said wire is drawn through said die to form a grooved wire, separating said grooved wire into individual jewelry links, and assembling said individual jewelry links into said hollow jewelry item.

2. The method of claim 1, wherein said die has a conical cross section defined between said inlet and said outlet and wherein said method further comprises drawing said wire though said conical cross section and forming a substantially circular profile around said wire, with said groove interrupting said circular profile.

3. The method of claim 1, wherein said groove forming element comprises a forming rod disposed between said inlet and said outlet, and wherein said method comprises forming an open axially-extending groove in said wire with said forming rod.

4. The method of claim 3, wherein said forming rod has a circular cross section, wherein said die has a drawing channel located between said inlet and said outlet and wherein said method further comprises forming a crescent shaped cross section in said wire between said rod and said drawing channel.

5. The method of claim 1, wherein said outlet has a predetermined cross sectional area and said groove forming element has a cross sectional area less than said predetermined cross sectional area of said outlet, and wherein said method further comprises forming said groove with a cross sectional area less than the cross sectional area of said wire as said wire exits said outlet.

6. The method of claim 1, wherein said wire comprises solid wire having a circular cross section and wherein said method further comprises forming said groove along an outer surface portion of said circular cross section.

7. The method of claim 1, wherein said grooved wire has a substantially crescent shaped cross section.

8. The method of claim 1, wherein said grooved wire has a generally polygonal shaped periphery.

9. The method of claim 1, wherein said grooved wire has a generally oval shaped periphery.

10. The method of claim 1, wherein said groove has a generally oval shaped cross section.

11. The method of claim 1, wherein an individual jewelry link formed from said grooved wire further comprises:

a solid thick wall portion;

a pair of arms extending from said thick wall portion; and an open channel having an open mouth formed in said hollow wire and located between said arms, said channel being eccentrically radially offset from said thick wall portion.

12. The method of claim 11, wherein each of said pair of arms tapers toward and terminates at said open mouth.

13. The method of claim 11, further comprising a facet cut into said Thick wall portion.

14. The method of claim 1, wherein said individual jewelry links are formed by separating said grooved wire into individual lengths of wire and bending said individual lengths of wire into annular configuration.

15. The method of claim 1, wherein said individual jewelry links are formed by wrapping said grooved wire around a support and separating said grooved wire into said individual jewelry links.

16. The method of claim 1, wherein said hollow jewelry item is a jewelry rope chain.

* * * * *